US005880086A

United States Patent [19]

Weinelt et al.

[11] Patent Number: 5,880,086

[45] Date of Patent: Mar. 9, 1999

[54] LAUNDRY SOFTENER CONCENTRATES

[75] Inventors: Frank Weinelt, Burgkirchen; Hans-Jürgen Scholz, Alzenau; Manfred Schreiber, Frankfurt am Main, all of Germany

[73] Assignee: Clariant GmbH, Germany

[21] Appl. No.: 16,997

[22] Filed: Feb. 2, 1998

Related U.S. Application Data

[63] Continuation of Ser. No. 472,384, Jun. 7, 1995, abandoned.

[30] Foreign Application Priority Data

Jun. 9, 1994 [DE] Germany ..... 44 20 188.5

[51] Int. Cl.[6] ..... C11D 1/62; C11D 1/835; C11D 1/72

[52] U.S. Cl. ..... 510/504; 510/329; 510/330; 510/515; 510/524; 510/289; 510/308; 510/327; 510/356; 510/421; 510/413

[56] References Cited

U.S. PATENT DOCUMENTS

| | | | |
|---|---|---|---|
| 4,162,874 | 7/1979 | DeBlock et al. | 252/8.8 |
| 4,233,164 | 11/1980 | Davis et al. | 252/8.8 |
| 4,237,016 | 12/1980 | Rudkin et al | 252/8.8 |
| 4,320,013 | 3/1982 | Luhman et al. | 252/8.8 |
| 4,422,949 | 12/1983 | Ooms | 252/8.8 |
| 4,786,421 | 11/1988 | Butterworth et al. | 252/8.8 |
| 4,933,096 | 6/1990 | Demeyere et al. | 252/8.8 |
| 5,185,088 | 2/1993 | Hartman et al. | 252/86 |
| 5,500,138 | 3/1996 | Bacon et al. | 252/8.8 |
| 5,531,910 | 7/1996 | Sevens et al. | 510/102 |
| 5,545,350 | 8/1996 | Baker et al. | 510/517 |

*Primary Examiner*—Paul Lieberman
*Assistant Examiner*—Charles Boyer
*Attorney, Agent, or Firm*—Connolly & Hutz

[57] ABSTRACT

The invention relates to laundry softener concentrates comprising a) 5–40% by weight of a cationic softening agent, b) 0.1–25% by weight of an ester of a $C_1$–$C_{22}$-carboxylic acid with a di-, tri- or tetrahydric alcohol having 2 to 10 carbon atoms, c) 0–10% by weight of a nonionic dispersing agent, d) 0–20% by weight of a polyglycol and e) water and if appropriate other customary auxiliaries corresponding to the balance to give 100% by weight, and furthermore the use thereof for the preparation of laundry softener emulsions and laundry softener emulsions comprising the laundry softener concentrate.

13 Claims, No Drawings

LAUNDRY SOFTENER CONCENTRATES

This application is a Continuation of U.S. Ser. No. 08/472,384 filed Jul. 7, 1995 now abandoned.

Washed textiles, especially those of natural fibers, exhibit an unpleasant harshening after drying. Furthermore, electrostatic charging of synthetic fibers during wearing is an unpleasant property.

Such negative properties of machine laundry can be largely eliminated by after-treatment of the washed goods with so-called laundry softeners in the last rinsing operation. The life of a piece of laundry is also lengthened detectably. Furthermore, the residual moisture after spinning is reduced and the drying time is thereby shortened by the use of laundry softeners. A good concentrate of laundry softeners must meet the following requirements: good dispersibility in cold water, no after-thickening of the formulation during storage, no separation phenomenon in the formulation and no formation of sediment.

DE-A-29 23 141 discloses laundry softeners comprising quaternary ammonium compounds as cationic softening agents. The laundry softeners described therein meet the abovementioned requirements by combination of the quaternary ammonium compounds which serve as the laundry softener with a fatty acid alkylolamidoethoxylate.

DE-A-30 25 369 mentions laundry softener concentrates comprising quaternary ammonium compounds as cationic softening agents. The preparation of the laundry softener concentrates described therein is achieved by addition of fatty acid alkylolamidoxyalkylates and nonionic dispersing agents or emulsifiers based on oxyalkylates, which also help to render the concentrate readily dispersible in cold water.

DE-A-32 04 165 describes concentrated laundry softeners based on quaternary ammonium compounds customary for laundry softeners. The requirements of a concentrate of laundry softeners are met by combination of the quaternary ammonium compounds with a certain amount of a fatty amine polyglycol ether.

It has now been found that highly concentrated, highly liquid laundry softeners which meet all the requirements of a good concentrate can be prepared by combination of cationic softening agents with esters of saturated and/or unsaturated $C_1$–$C_{21}$-carboxylic acids with di- to tetrahydric alcohols.

The invention thus relates to laundry softener concentrates comprising a) 5–40% by weight, preferably 10–25% by weight, of a cationic softening agent, b) 0.1–25% by weight, preferably 0.5–15% by weight, of an ester of a $C_1$–$C_{22}$-carboxylic acid with a di-, tri- or tetrahydric alcohol having 2 to 10 carbon atoms and, if appropriate, c) 0–10% by weight, preferably 0.5–5% by weight, of a nonionic dispersing agent, d) 0–20% by weight, preferably 0.5–10% by weight, of a polyglycol and e) water and if appropriate further customary auxiliaries corresponding to the balance to give 100% by weight.

Possible cationic softening constituents of the laundry softener concentrates according to the invention are the quaternary ammonium compounds which contain lipophilic radicals and are known for this use, above all those compounds which are characterized by the formulae I to XII.

I

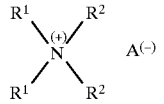

II

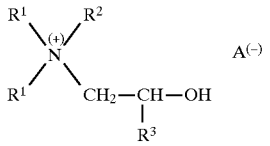

III

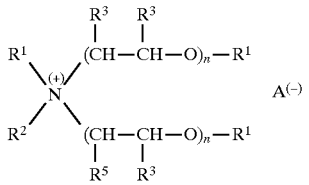

IV

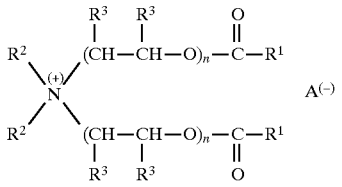

V

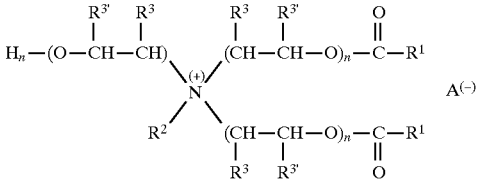

VI

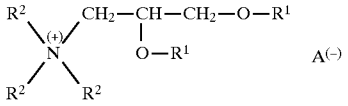

VII

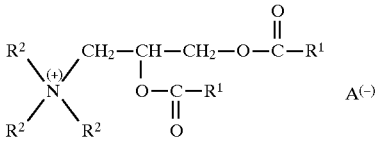

VIII

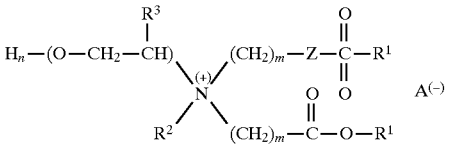

IX

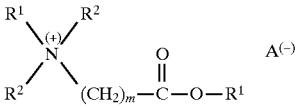

X

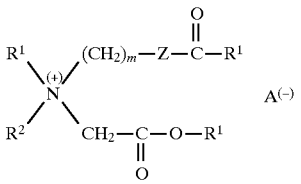

-continued

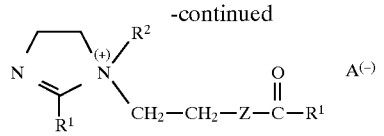

XI

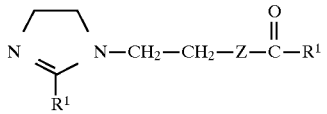

XII

In these formulae, the symbols have the following meanings:

$R^1$ alkyl or alkenyl radicals having 6 to 22 carbon atoms, in particular alkyl or alkenyl radicals having 8 to 18 carbon atoms. These include, in particular, C-chain compounds such as occur in coconut fatty acid alkyl, tallow fatty acid alkyl, oleic acid alkyl and sperm oil fatty acid alkyl.

$R^2$ alkyl radical having 1 to 4 carbon atoms, in particular methyl, $R^3$,$R^{3'}$ hydrogen or methyl, where radicals $R^3$ and $R^{3'}$ on adjacent carbon atoms are not simultaneously methyl, n an integer from 1 to 5, preferably 1, m the number 2 or 3, preferably 2, Z NH or O, $A^{\ominus}$ an anion, preferably chloride, bromide or the methosulfate, ethosulfate, methophosphate or ethophosphate ion.

Preferred compounds are those of the formula IV in which $R^1$ is $C_6$–$C_{22}$-alkyl, particularly preferably $C_8$–$C_{18}$-alkyl, $R^2$ is $C_1$–$C_4$-alkyl, particularly preferably methyl, $R^3$ and $R^{3'}$ are hydrogen and n is 1, and the compounds of the formula VII in which $R^1$ is $C_8$–$C_{18}$-alkyl and $R^2$ is methyl, as well as the compounds of the formula VIII in which $R^1$ is $C_8$–$C_{18}$-alkyl, $R^2$ is methyl, $R^3$ is hydrogen, Z is oxygen, m is 2 and n is 1.

The compounds of the formula XII are usually employed with an equimolar amount of an acid, for example acetic acid, phosphoric acid or hydrochloric acid.

For preparation of the liquid laundry softener concentrates according to the invention, these cationic softening constituents are expediently employed in the form of their concentrated solutions in $C_1$–$C_3$-alcohols, preferably isopropanol, or in a mixture of these alcohols with water. The concentrates according to the invention may therefore comprise a certain amount of these alcohols.

Esters of $C_1$–$C_{22}$-carboxylic acids with di- to tetrahydric alcohols are employed as other essential constituents.

These carboxylic acids include both saturated carboxylic acids having 1 to 22 carbon atoms, in particular 7 to 17 carbon atoms, and unsaturated carboxylic acids having 3 to 22 carbon atoms, in particular 12 to 18 carbon atoms.

Examples of such carboxylic acids which may be mentioned are:

lauric acid, myristic acid, coconut fatty acid, palm stearin fatty acid, tallow fatty acid, erucic fatty acid, oleic acid, linoleic acid, linolenic acid and mixtures thereof.

Suitable di-, tri- or tetrahydric alcohols are alcohols having 2 to 10 carbon atoms. Dihydric alcohols which are used are glycols, preferably ethylene glycol, propylene glycol, polyethylene glycol and polypropylene glycol. The preferred trihydric alcohol is glycerol and the preferred tetrahydric alcohol is pentaerythritol. The compounds of the following formulae XIII to XVI are used in particular.

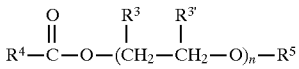

XIII

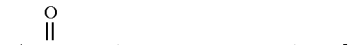

XIV

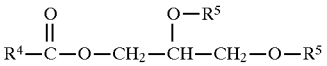

XV

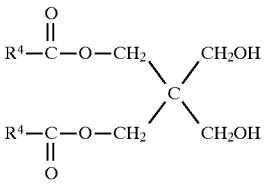

XVI

In these formulae, the symbols have the following meanings:

$R^3$,$R^{3'}$ hydrogen or methyl, where radicals $R^3$ and $R^{3'}$ on adjacent carbon atoms are not simultaneously methyl, $R^4$ an alkyl radical having 1 to 22 carbon atoms, in particular 7 to 17 carbon atoms, and/or an alkylene radical having 2 to 22 carbon atoms, in particular 12 to 18 carbon atoms, $R^5$ is hydrogen or the group C(O)—$R^4$ and n is a number from 1 to 5, preferably 1.

Mixtures of compounds of the formulae XIII and XV in which $R^3$ and $R^3$ are hydrogen and n is 2 or 3, such as are usually obtained by transesterification of triglycerides with ethylene glycols, are particularly preferred.

It has been found that the esters corresponding to component b) act as dispersing agents, and furthermore, in contrast to customary emulsifiers, are active softening agents and are therefore suitable for assisting the quaternary ammonium compounds in their softening action. Moreover, the combination according to the invention of esters corresponding to component b) with cationic softening agents corresponding to component a) is especially suitable in particular for preparation of laundry softeners having a high solids content.

Another constituent can be customary nonionic dispersing agents based on oxyalkylates, which help to render the softener readily dispersible in cold water. Suitable nonionic dispersing agents are reaction products of in each case about 2–12 mol of ethylene oxide with an alkylphenol, for example xylenol, but also with an alkylphenol having a long alkyl radical of 8 to 10 carbon atoms or with a fatty alcohol or fatty amine having 6 to 22 carbon atoms, preferably 8 to 18 carbon atoms. These include, in particular, reaction products of about 5 to 8 mol of ethylene oxide with 1 mol of alkylphenol or 1 mol of fatty alcohol or fatty amine or of a mixture of such fatty alcohols and/or fatty amines. The amount of these nonionic dispersing agents is 0 to 10% by weight, preferably 0.5 to 5% by weight, based on the total weight of the concentrate.

If appropriate, the laundry softener concentrates according to the invention comprise 0 to 20, preferably 0.5 to 10% by weight of a polyglycol, polyethylene glycols having an $M_w$ of 400 to 1000 (weight average) and/or polypropylene glycols and the $C_1$–$C_4$-alkyl ethers of these compounds being preferred. These compounds show a solubilizing action and are therefore particularly suitable as an additive for the preparation of transparent laundry softener concentrates.

The concentrated laundry softeners according to the invention furthermore can also comprise other customary substances and auxiliaries, which are either already admixed in the concentrate or added separately to the ready-to-use diluted laundry softener. These are cationic or nonionic surface-active substances, electrolytes, acidifying agents, organic complexing agents, optical brighteners, solubilizing agents and dyestuffs and fragrances. They serve to additionally influence the hand of the goods or other properties of the textile to be treated or to adjust the viscosity, regulate the pH or increase the low temperature stability.

The laundry softener concentrates according to the invention have a solids content of at least 25% by weight, preferably 25 to 75% by weight, particularly preferably 25 to 60% by weight.

The laundry softener concentrates according to the invention impart a pleasant and soft hand to any desired textile materials, in particular those of naturally occurring or regenerated cellulose, wool, cellulose triacetate, polyamide, polyacrylonitrile, polyester or polypropylene. Use as a laundry after-treatment composition for terry towelling and underwear is particularly advantageous.

These concentrates are prepared by simply mixing or dispersing the individual components a) to d) and if appropriate e) in water. The concentrates either comprise in each case one compound of components a) to e), or comprise a mixture of two or more compounds of components a) to e) within the stated limits. If a mixture of two or more compounds of components a, b, c, d or e is present, the mixing ratio thereof with one another is entirely non-critical and can assume any desired value. The amounts of the individual components a) to d) are chosen within the stated limits such that the finished concentrate, including any additional amounts of water and auxiliaries, results in 100% by weight. The amount of laundry softener concentrates according to the invention employed is about 10–20 g per 4 kg of laundry. These concentrates are used in the customary manner by adding them to the last rinsing water after the textile wash. The laundry softener concentrates described above have good softening properties. They are distinguished by a good perfume compatibility and stability. The cold water dispersibility is outstanding. No gel formation has been observed. The formulations also display a low viscosity in highly concentrated form. No subsequent thickening or gelling occurs after a prolonged storage time (30 days). The invention thus also relates to the use of the laundry softener concentrates according to the invention for the preparation of emulsions.

EXAMPLES

Some laundry softeners according to the invention are described in the following examples. Percentage data are in all cases percentages by weight. The formulations are prepared by stirring the liquid, powdered or molten components into water, which is heated if appropriate.

Example 1

(25% solids content)

| | |
|---|---|
| Distearyldimethylammonium chloride (AI) | 15.0% |
| Glycerol/ethylene glycol partial ester 1:1 | 7.5% |
| Polyethylene glycol 400 | 2.5% |
| Fatty alcohol polyglycol ether +8 EO | 0.5% |
| $MgCl_2 \times 6\ H_2O$ 20% strength in demineralized water | 5.0% |
| Water (0° German hardness), perfume (max. 1.5%), Dyestuff | to 100.0% |

Example 2

(30% solids content)

| | |
|---|---|
| Triethanolamine ester quat-methosulfate (AI) | 20.0% |
| Glycerol/ethylene glycol partial ester 0.66:1 | 3.0% |
| Polyethylene glycol 400 | 3.5% |
| Fatty alcohol polyglycol ether +15 EO | 2.5% |
| Glycerol monostearate | 2.5% |
| $MgCl_2 \times 6\ H_2O$ 20% strength in demineralized water | 5.0% |
| Water (0° German hardness), perfume (max. 1.8%), Dyestuff | to 100.0% |

Example 3

(40% solids content)

| | |
|---|---|
| Distearyldimethylammonium chloride (AI) | 25.0% |
| Glycerol/ethylene glycol partial ester 0.5:1 | 1.5% |
| Polyethylene glycol 200 | 3.5% |
| Fatty alcohol polyglycol ether +20 EO | 1.5% |
| Fatty amine oxyethylate +25 EO | 7.5% |
| Myristic acid | 1.0% |
| $MgCl_2 \times 6\ H_2O$ 20% strength in demineralized water | 5.0% |
| Water (0° German hardness), perfume (max. 2.4%), Dyestuff | to 100.0% |

Appearance: liquid dispersion, dilutable with cold water in any proportion.

Example 4

(50% of softening components)

| | |
|---|---|
| Triethanolamine ester quat-methosulfate (AI) | 40.0% |
| Tetraglycerol monolaurate | 5.0% |
| Polyethylene glycol 400 | 5.0% |
| Fatty alcohol polyglycol ether +5 EO | 10.0% |
| 1,2-Propanediol | 20.0% |
| Isopropanol | 5.0% |
| Water (0° German hardness), dyestuff, perfume (about 3%) | to 100.0% |

Appearance: low-viscosity, clear solution can be processed 1:4 to 1:10 with cold water by simple shaking to give a readily dispersible emulsion.

Example 5

(60% of softening components)

| | |
|---|---|
| Di-tallow alkyldimethylimidazolinium methosulfate (AI) | 40.0% |
| Diglycerol monolaurate | 5.0% |
| Fatty amine oxyethylate +5 EO | 7.5% |
| Polyoxyethylene 20 sorbitan monolaurate | 2.5% |
| 1,2-Propanediol | 20.0% |
| 5 N Hydrochloric acid | 3.8% |
| Isopropanol, dyestuff, perfume | to 100.0% |

Appearance: Low-viscosity, clear solution can be processed 1:4 to 1:10 with cold water by simple shaking to give readily dispersible emulsions.

We claim:

1. A laundry softener concentrate comprising a) 5–40% by weight of a cationic softening agent, selected from the group

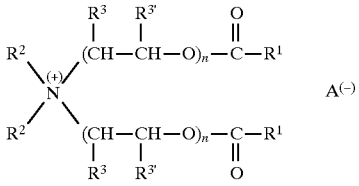

(IV)

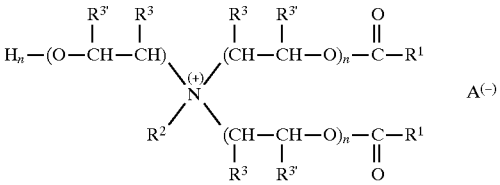

(V)

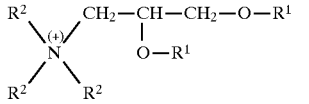

(VI)

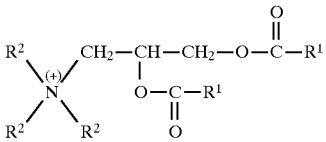

(VII)

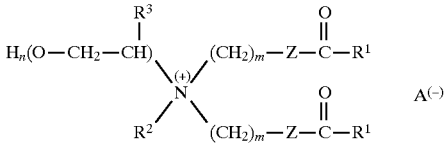

(VIII)

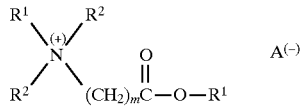

(IX)

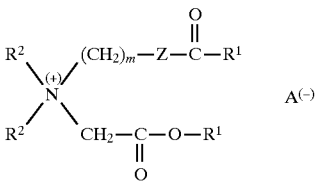

(X)

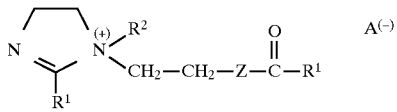

(XI)

wherein $R^1$ is an alkyl or alkenyl radicals having 6 to 22 carbon atoms, $R^2$ is an alkyl radical having 1 to 4 carbon atoms, n is an integer from 1 to 5, m a number from 2 to 3, Z is NH or O, and $A^{(-)}$ is an anion, b) 0.1–25% by weight of an ester of a $C_1$–$C_{22}$-carboxylic acid with a di-, tri- or tetrahydric alcohol having 2 to 10 carbon atoms and is a mixture of the esters of formulae XIII and XV

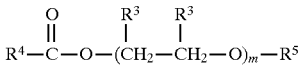

(XIII)

-continued

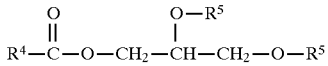

(XV)

in which $R^4$ is an alkyl radical having 1 to 22 carbon atoms, and/or an alkenyl radical having 2 to 22 carbon atoms, $R^3$ and $R^{3'}$ are hydrogen or $R^5$ is hydrogen or the group C(O)—$R^4$ and m is a number from 2 to 3, is employed as component b), c) 0–10% by weight of a nonionic dispersing agent, d) 0–20% by weight of a polyglycol and e) water and optionally auxiliaries corresponding to the balance to give 100% by weight.

2. A concentrate as claimed in claim 1, comprising

10–25% by weight of component a), 0.5–15% by weight of component b), 0.5–5% by weight of component c), 0.5–10% by weight of component d)

and water and optionally perfume and dyestuffs in amounts corresponding to the balance to give 100% by weight.

3. A concentrate as claimed in claim 1, wherein a compound of the formula IV

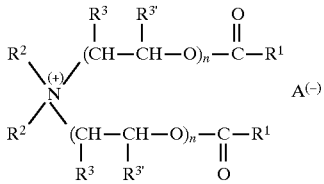

IV in which $R^1$ is $C_8$–$C_{18}$-alkyl, $R^2$ is methyl, $R^3$ and $R^{3'}$ are hydrogen and n is 1 is employed as component a).

4. A concentrate as claimed in claim 1 wherein a compound of the formula VII

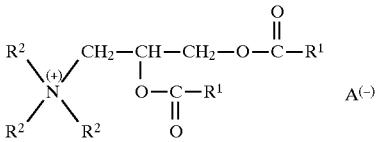

VII in which $R^1$ is $C_8$–$C_{18}$-alkyl and $R^2$ is methyl is employed as component a).

5. A concentrate as claimed in claim 1, wherein a compound of the formula VIII

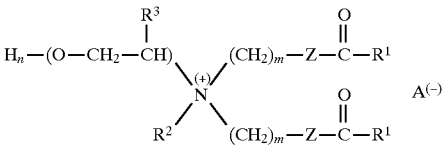

VIII in which $R^1$ is $C_8$–$C_{18}$-alkyl, $R^2$ is methyl, $R^3$ is hydrogen, Z is oxygen, m is 2 and n is 1 is employed as component a).

6. A concentrate as claimed in claim 1, wherein an oxyethylated alkylphenol, oxyethylated fatty amine and/or oxyethylated fatty alcohol is employed as component c).

7. A concentrate as claimed in claim 1, wherein a polyethylene glycol, polypropylene glycol and the $C_1$–$C_4$-alkyl ether of one of these compounds is employed as component d).

8. A concentrate as claimed in claim 1, wherein the solids content is at least 25% by weight.

9. A concentrate as claimed in claim 1, wherein cationic or nonionic surface-active substances, electrolytes, acidifying agents, organic completing agents, optical brighteners, solubilizing agents and dyestuffs and fragrances are employed as auxiliaries.

10. A laundry softener emulsion comprising the laundry softener concentrate as claimed in claim 1.

11. The concentrate as claimed in claim 1, wherein $R^4$ is an alkyl radical having from 7 to 17 carbon atoms and/or an alkenyl radical having from 12 to 18 carbon atoms.

12. The concentrate as claimed in claim 1, wherein the esters are obtained by transesterification of triglycerides with ethylene glycols, is employed as component b.

13. A laundry softener concentrate comprising a) a cationic softening agent, selected from the group consisting of formulae IV through XI

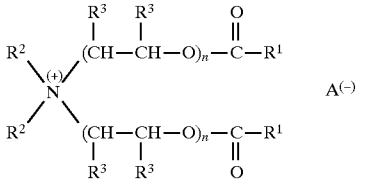

(IV)

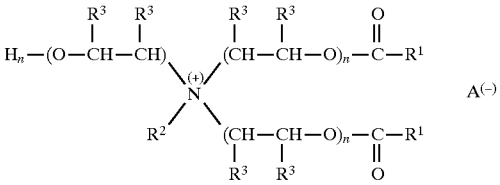

(V)

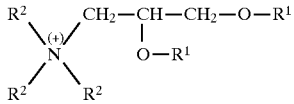

(VI)

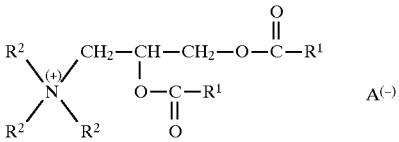

(VII)

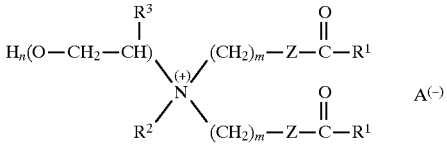

(VIII)

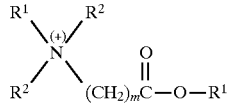

(IX)

-continued

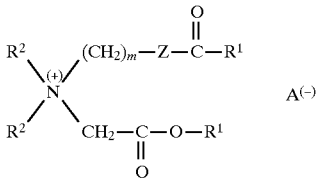

(X)

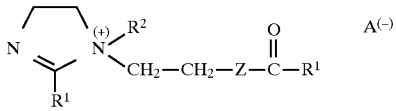

(XI)

wherein $R^1$ is an alkyl or alkenyl radicals having 6 to 22 carbon atoms, $R^2$ is an alkyl radical having 1 to 4 carbon atoms, n is an integer from 1 to 5, m is a number from 2 to 3, Z is NH or O, and $A^{(-)}$ is an anion, b) an ester of a $C_1$–$C_{22}$-carboxylic acid with a di-, tri- or tetrahydric alcohol having 2 to 10 carbon atoms and is a mixture of the esters of formulae XIII and XV

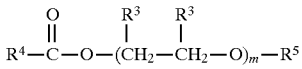

(XIII)

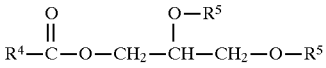

(XV)

in which $R^4$ is an alkyl radical having 1 to 22 carbon atoms, and/or an alkenyl radical having 2 to 22 carbon atoms, $R^3$ and $R^{3'}$ are hydrogen, $R^5$ is hydrogen or the group C(O)—$R^4$ and m is a number from 2 to 3, is employed as component b)

c) water, and optionally a nonionic dispersing agent, polyglycol and/or auxiliaries.

* * * * *